US006446290B1

(12) United States Patent
Gidtske

(10) Patent No.: US 6,446,290 B1
(45) Date of Patent: Sep. 10, 2002

(54) DEVICE FOR VENTILATION OF BABY COT, CRADLE OR BAG FOR BABY CARRIAGE

(76) Inventor: Karl Gidtske, Gardermoveien 201, N-2060 Gardermoen (NO)

( * ) Notice: Subject to any disclaimer, the term of this patent is extended or adjusted under 35 U.S.C. 154(b) by 0 days.

(21) Appl. No.: 09/623,445

(22) PCT Filed: Mar. 5, 1998

(86) PCT No.: PCT/NO98/00073

§ 371 (c)(1),
(2), (4) Date: Sep. 5, 2000

(87) PCT Pub. No.: WO99/44478

PCT Pub. Date: Sep. 10, 1999

(51) Int. Cl.[7] ..... A47C 21/04; A47D 7/00

(52) U.S. Cl. ..... 5/725; 5/652.1; 5/655; 5/284; 5/93.1

(58) Field of Search ..... 5/93.1, 98.1, 284, 5/421, 725, 652.1, 655, 946

(56) References Cited

U.S. PATENT DOCUMENTS 2,287,907 A * 6/1942 Schettler et al. ..... 5/98.1
5,561,879 A 10/1996 Everall
5,566,407 A 10/1996 Lien
5,697,113 A * 12/1997 Shatz et al. ..... 5/725
6,055,690 A * 5/2000 Koenig ..... 5/652.1
6,131,216 A * 10/2000 Pine ..... 5/946
6,178,573 B1 * 1/2001 Wagner et al. ..... 5/946

FOREIGN PATENT DOCUMENTS

DE 30 25 846 1/1981

* cited by examiner

*Primary Examiner*—Michael F. Trettel
(74) *Attorney, Agent, or Firm*—Barry R. Lipsitz; Douglas M. McAllister

(57) ABSTRACT

An arrangement for ventilation of a cot, cradle, carrycot or perambulator carrycot, comprising a substantially flat bottom, closed side walls extending vertically upwards from the bottom, and a substantially open top, and also a head end and a foot end. At least one of the closed side walls is equipped with at least one ventilation aperture at the head end of the cot or carrycot, close to the bottom of the cot or carrycot at a level that is above any mattress that might be placed therein, or the bottom of the cot or carrycot is equipped with such an aperture, with a corresponding opening or slit in the mattress.

10 Claims, 4 Drawing Sheets

DEVICE FOR VENTILATION OF BABY COT, CRADLE OR BAG FOR BABY CARRIAGE

The present invention relates to an arrangement for ventilation of a cot, cradle, carrycot or perambulator carrycot, comprising a substantially flat bottom, closed sides extending vertically upwards from the bottom and a substantially open top, and also a head end and a foot end, in accordance with the preamble in claim 1, and a mattress for the same, in accordance with the preamble of claim 6.

The point of departure for the present invention is the many tragic deaths of infants that occur each year, and which as a rule are described as cot deaths.

The causes of cot death (Sudden Infant Death Syndrome - SIDS) have been discussed and researched for quite a long time, and even though this phenomenon is still being researched, the majority of researchers are now agreed that at least a part of the cause is the increased concentration of $CO_2$ in the infant's inhaled air. It is a matter of common knowledge that infants have quite a small lung capacity and a less than fully developed respiratory system. Infants will therefore tolerate inspiration of inhaled air with a high $CO_2$ concentration to a far lesser extent than older children and adults.

Statistics show that there is a greater frequency of cots deaths in Norway than in comparable countries. As a basis for this invention, special consideration has been given to what is particularly distinctive about the way Norwegian infants are placed when put to bed. The distinguishing features have been found to include that in Norway relatively high sides are used on cots, perambulators etc. and that there is a clear tendency, in part because of the cold climate, to use thick quilts, which as a rule are packed tightly around the infant. This means that the air volume available in the immediate vicinity of the infant's head is relatively small. When the infant respires in this air volume, if there is otherwise very little air circulation, an ever-increasing concentration of $CO_2$ will build up therein.

It is a matter of common knowledge that $CO_2$ is heavier than both oxygen and nitrogen, and the $CO_2$ concentration will therefore be higher close to the mattress than at a more elevated level in the cot or carrycot. In particular when a baby lies on his stomach, his mouth and nose will be at a very small distance from the mattress, and he will inhale air having a higher $CO_2$ concentration than if he had, for example, been lying on his back.

Since it has become known that lying on the stomach might have a connection with cot death, more and more parents have started to put their baby to bed lying on his side or back. This has led to a clear reduction in the number of cot deaths. However, lying on the stomach does have its advantages. The baby feels more secure, since he will constantly have "facial contact" with a soft underlying surface, in contrast to the insecure feeling some babies have when they lie on their back without anything to place their cheeks on. Furthermore, babies have on occasion been known to regurgitate milk or to vomit whilst lying in their cot or perambulator. If the infant is lying on his back, it will be difficult for the regurgitated matter or vomit to run out of his mouth, and it may run back into his throat and obstruct the airway. At worst, this may result in choking. In addition, there are also some babies who cannot settle unless they are put down on their stomach.

It is true that on the market today there are already cots with barred sides which, of course, have an opening between each bar. However, these openings are disposed around all sides of the cot, and this provides air exchange across the whole cot. In any case, the purpose of the openings between each bar has not been to remove $CO_2$ from the area around the infant's head, but to allow the infant to see out through the side walls of the cot. Insofar as carrycots or perambulator carrycots are concerned, these are basically constructed with closed side walls. One exception is disclosed in FR 2,460,651, which makes known a carrycot having large openings in the side. However, between the lower edge of the openings and the mattress there is a sill which effectively prevents the escape of $CO_2$. There are also cots or carrycots which are equipped with a hole in the bottom, but the purpose of these holes is to transport moisture from the mattress. Virtually no movement of air takes place through these holes, since as a rule they will be blocked by a mattress. U.S. Pat. No. 4,923,104 teaches a rucksack-like carrier where again the air vents are not positioned to allow $CO_2$ to escape.

One object of the present invention is to provide an arrangement in a cot, carrycot or perambulator carrycot which completely eliminates the risk of a build-up in the concentration of $CO_2$ around the infant's mouth and nose. This is achieved by the characterising features disclosed in claim 1. Another object of the invention is to provide a mattress in accordance with the characterising features disclosed in claim 6. According to a preferred embodiment, two opposite side walls or two opposite sides of the bottom are equipped with a ventilation aperture, so that the infant's nose or mouth will be close to a ventilation aperture regardless of which side the infant is lying on.

The invention will be described in more detail below with reference to the attached figures, wherein.

Figure 1:
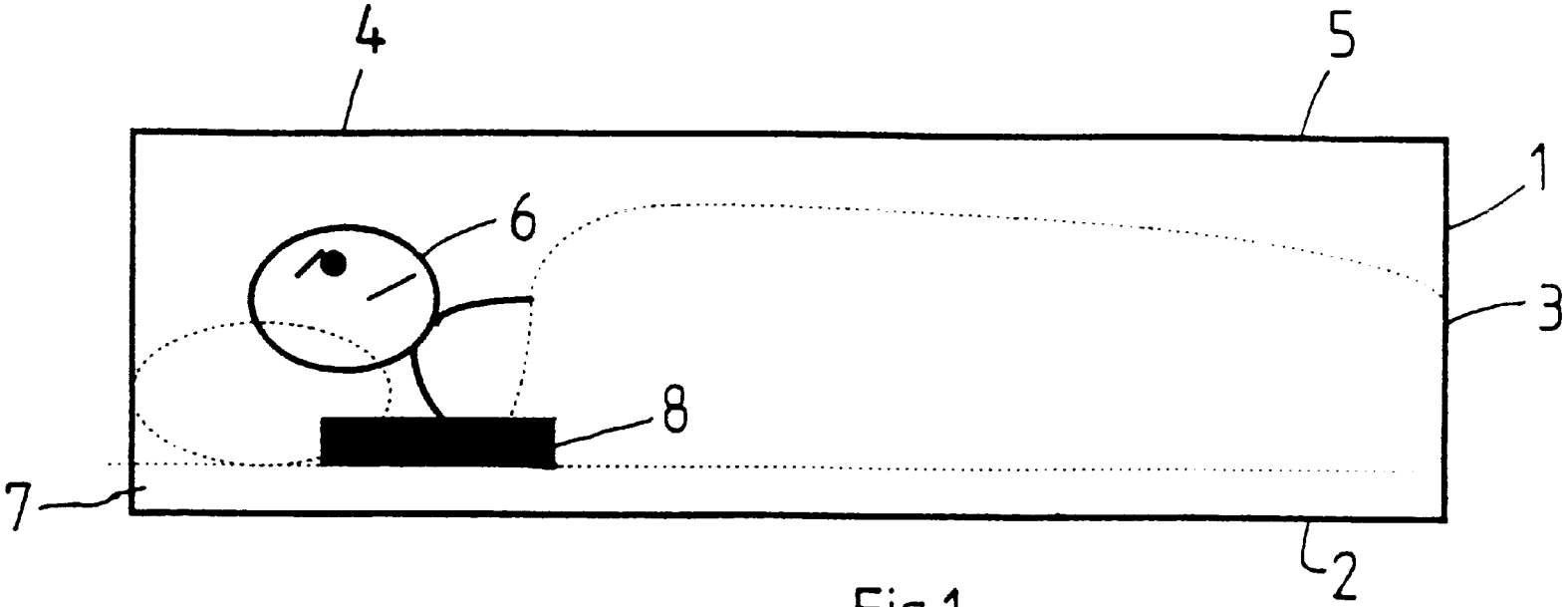
FIG. 1 is a schematic illustration of a perambulator carrycot seen from the side and in section, which exhibits one embodiment of the invention.

FIG. 1 shows a perambulator carrycot 1 which comprises a bottom 2 and side walls 3 extending vertically upwards from the bottom. The carrycot has a head end 4 and a foot end 5. An infant 6 lying on a mattress 7 is indicated schematically inside the carrycot. A ventilation aperture 8 is provided in the side wall 3 of the carrycot 1, immediately above the mattress and in the head end 4 of the carrycot 1.

Figure 2:
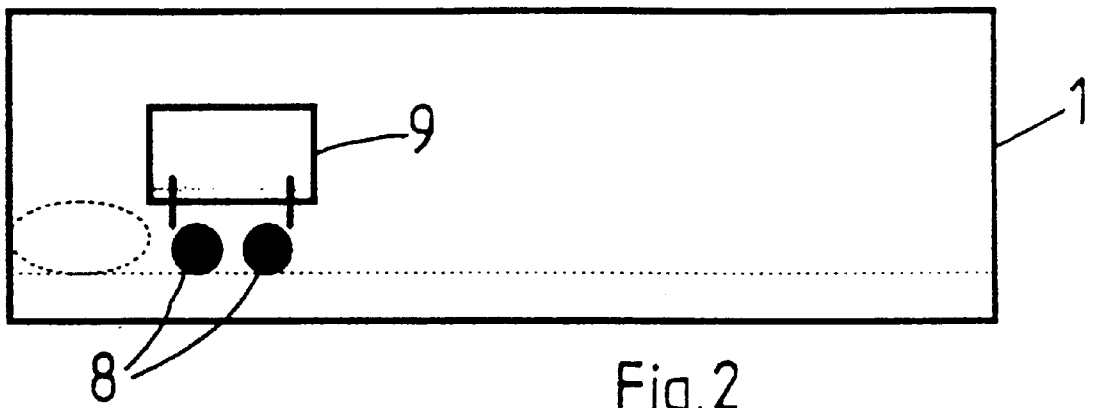
FIG. 2 shows a perambulator carrycot seen from the side, which exhibits a second embodiment of the invention with open ventilation apertures.
Figure 3:
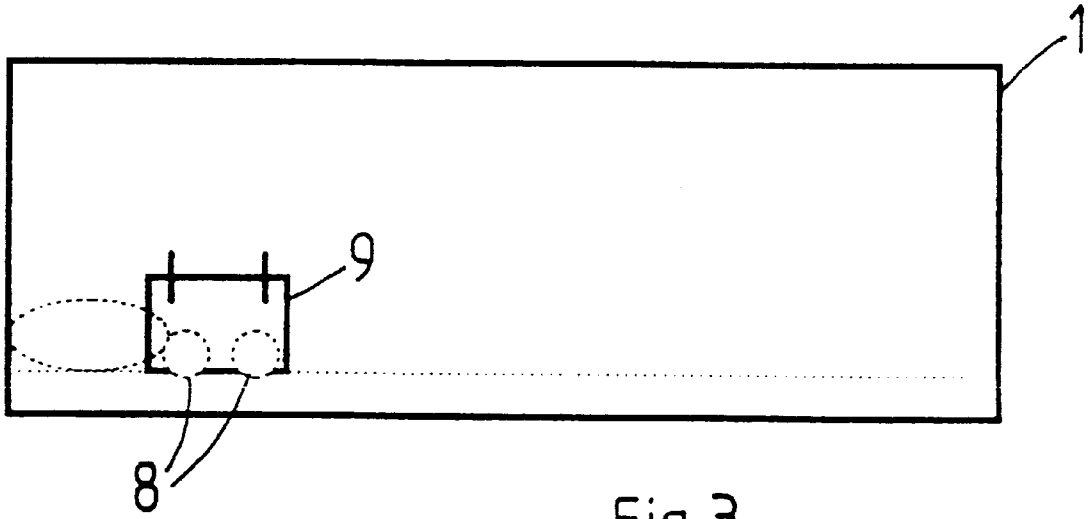
FIG. 3 shows the carrycot of FIG. 2 with closed ventilation apertures.

FIG. 2 shows a similar carrycot 1 equipped with two round ventilation apertures 8, and a flap 9, which, as can be seen from FIG. 3, is capable of being brought down over the ventilation apertures 8 in order to close them. Closing the ventilation apertures may be advantageous if it is windy, in order to prevent the infant from lying in a draught. When there is movement of air around the carrycot, there will not be the same risk of a build-up in the concentration of $CO_2$, and it is acceptable for the ventilation apertures to be closed.

Figure 4:
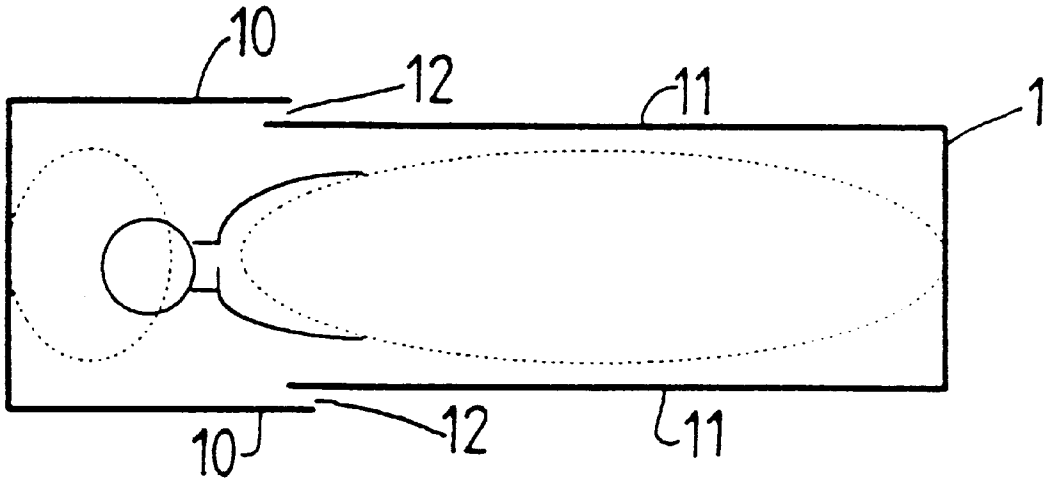
FIG. 4 shows a perambulator carrycot seen from above in a third embodiment of the invention.

FIG. 4 shows a further embodiment of the invention, wherein a carrycot 1 is equipped with side walls 10 at the head end, which are spaced apart at a slightly greater distance than side walls 11 which extend along the remaining length of the carrycot. In this way, gaps 12 are formed where the side walls 10 and 11 meet each other. To close these gaps, the side walls 10 may be arranged so that they can be pressed against the side walls 11 and abut thereon.

Figure 5:
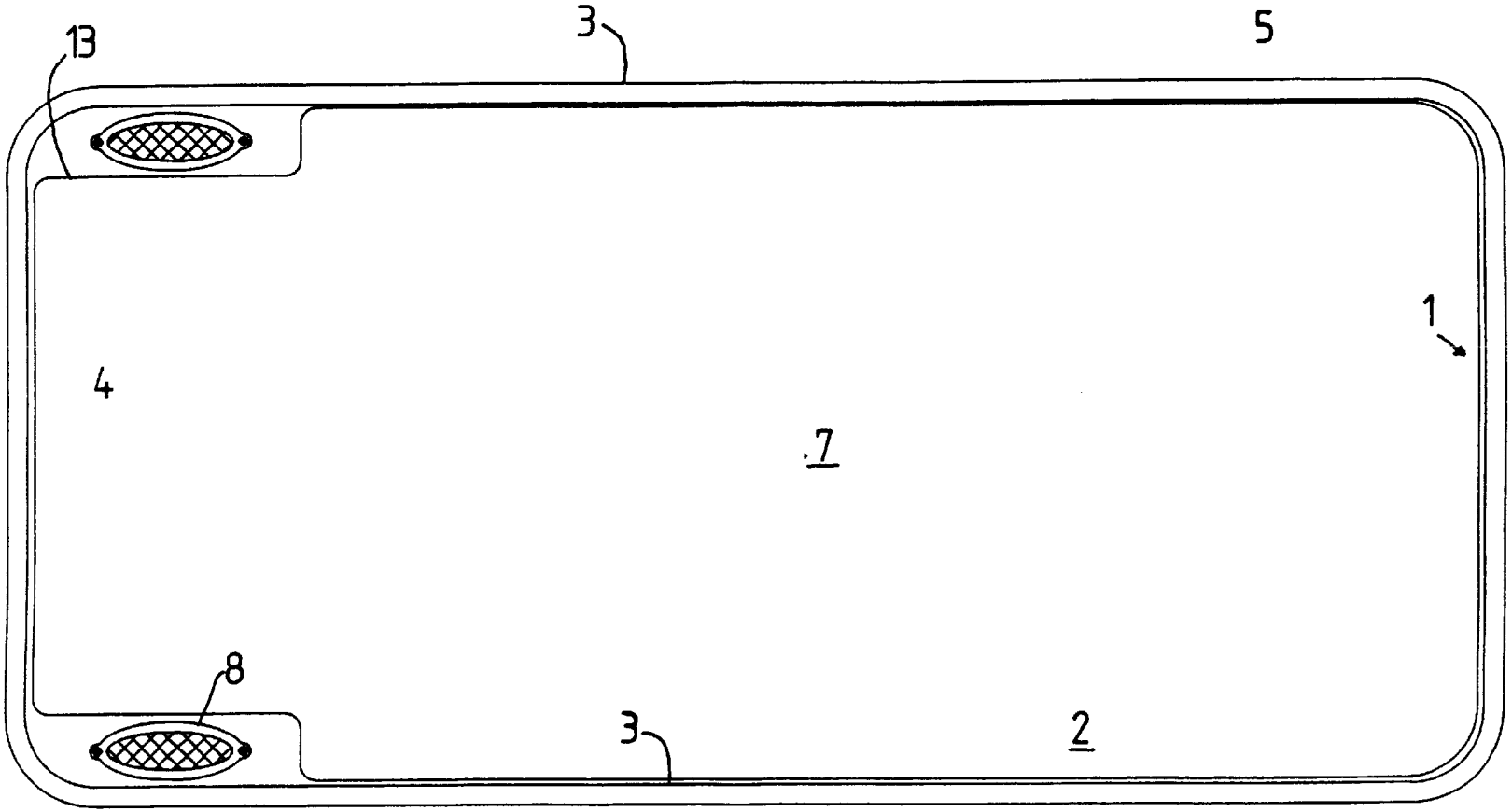
FIG. 5 shows a fourth embodiment of the invention, with apertures in the bottom.
Figure 6:
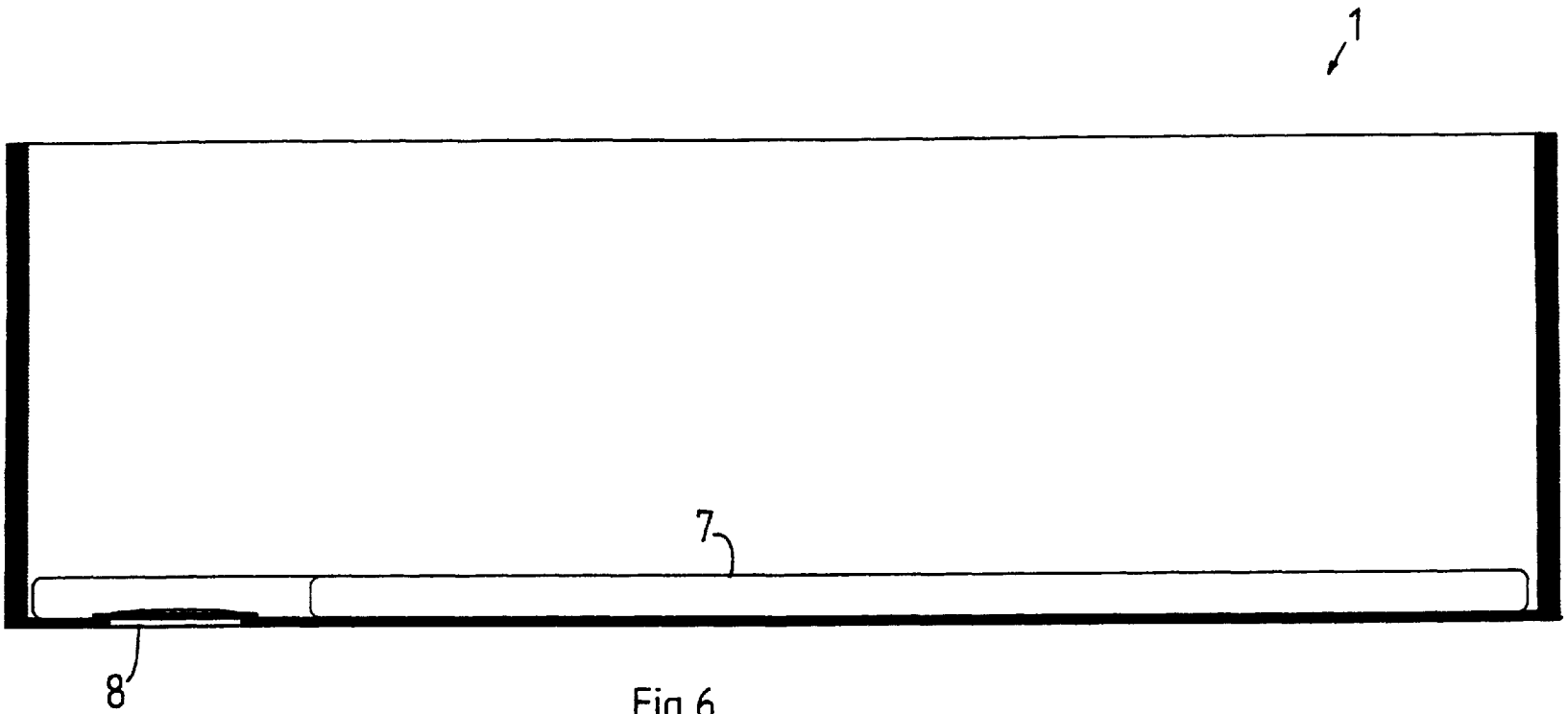
FIG. 6 shows the embodiment of FIG. 5 seen from the side.

FIGS. 5 and 6 show an embodiment of the invention wherein ventilation apertures 8 are provided in the bottom 2 of the carrycot 1. These apertures 8 are preferably made close to the side walls 3 of the carrycot 1. This allows the mattress 7 to be shaped so as to have a narrower head end portion 13, the width of which is adapted to the distance between the apertures 8 so as to ensure that these are exposed.

As illustrated, the ventilation aperture may be slit-shaped, rectangular or round, but may, of course, be of any other shape. The aperture should extend as far down towards the mattress as possible. Instead of a flap 9 on the outside of the carrycot, this flap may be arranged on the inside, or it may be replaced by a sliding flap which can be arranged slidably in grooves in the side wall or bottom. The ventilation apertures are preferably arranged on both sides of the carrycot or cot, but may also be arranged on one side only, and/or in the end wall of the carrycot or cot.

The ventilation apertures may also be equipped with a mosquito net or another material that is gas-permeable, but which prevents the passage of insects, particles or dust.

What is claimed is:

1. An arrangement for ventilation of an infant bed, comprising:

a substantially flat bed bottom, closed side walls extending vertically upwards from the bottom, a substantially open top, a head end, and a foot end;

a mattress having an upper surface for supporting an infant and a lower surface for resting on said bottom; and at least one ventilation aperture for the escape of air expelled from the infant and having a high $CO_2$ concentration arranged in the bottom within a region of said head end, said ventilation aperture having air passage to a space above said mattress upper surface;

wherein said mattress is adapted to cover said bottom except in the area of said aperture.

2. An arrangement according to claim 1, wherein the ventilation aperture is equipped with a flap for closing or opening the air passage through said aperture.

3. An arrangement according to claim 2, wherein the ventilation aperture is covered by a material which is gas-permeable, but which prevents the passage of insects, particles or dust.

4. An arrangement according to claim 1, wherein the ventilation aperture is covered by a material which is gas-permeable, but which prevents the passage of insects, particles or dust.

5. An arrangement according to claim 1, wherein said infant bed comprises one of a cot, cradle, carrycot or perambulator carrycot.

6. A mattress for an infant bed, said bed comprising a substantially flat bottom, closed side walls extending vertically upwards from the bottom, a substantially open top, a head end and a foot end, said mattress comprising:

an upper surface for supporting the infant and a lower surface to be supported by said bottom, said mattress having at least one air passage opening therethrough for interaction with at least one ventilation aperture for the escape of air expelled from the infant and having a high $CO_2$ concentration, said aperture arranged in said bottom within a region of the head end, and a head portion which is narrower than the width of the rest of the mattress, said head portion having its width approximately the same as a distance between a pair of apertures located at either side of the mattress head portion.

7. An arrangement according to claim 6, wherein said infant bed comprises one of a cot, cradle, carrycot or perambulator carrycot.

8. An arrangement for ventilation of an infant bed, comprising:

a substantially flat bed bottom, closed side walls extending vertically upwards from the bottom, a substantially open top, a head end, and a foot end;

a mattress having an upper surface for supporting an infant and a lower surface for resting on said bottom;

at least one ventilation aperture for the escape of air expelled from the infant and having a high $CO_2$ concentration arranged within a region of said head end, said ventilation aperture being arranged in a side wall immediately above the mattress upper surface; and a flap for closing or opening air passage through said ventilation aperture.

9. An arrangement according to claim 8, wherein said ventilation aperture is covered by a material which is gas-permeable, but which prevents the passage of insects, particles or dust.

10. An arrangement according to claim 8, wherein said infant bed comprises one of a cot, cradle, carrycot or perambulator carrycot.

* * * * *